US011054154B2

(12) United States Patent
Fujita et al.

(10) Patent No.: US 11,054,154 B2
(45) Date of Patent: Jul. 6, 2021

(54) OUTDOOR UNIT OF REFRIGERATION APPARATUS

(71) Applicant: Daikin Industries, LTD., Osaka (JP)

(72) Inventors: Hiroki Fujita, Osaka (JP); Yuuki Tanaka, Osaka (JP); Tooru Hamanaka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/608,700

(22) PCT Filed: Jun. 8, 2018

(86) PCT No.: PCT/JP2018/021961
§ 371 (c)(1),
(2) Date: Oct. 25, 2019

(87) PCT Pub. No.: WO2018/225846
PCT Pub. Date: Dec. 13, 2018

(65) Prior Publication Data

US 2020/0386420 A1 Dec. 10, 2020

(30) Foreign Application Priority Data

Jun. 9, 2017 (JP) ..... JP2017-114256

(51) Int. Cl.
*F24F 1/24* (2011.01)
*A62C 3/16* (2006.01)

(52) U.S. Cl.
CPC . *F24F 1/24* (2013.01); *A62C 3/16* (2013.01)

(58) Field of Classification Search
CPC ..... A62C 3/16; F24F 1/24
See application file for complete search history.

(56) References Cited

FOREIGN PATENT DOCUMENTS

| | | | | |
|---|---|---|---|---|
| JP | H7-18132 | U | | 3/1995 |
| JP | 2000-205604 | A | | 7/2000 |
| JP | 2007-85649 | A | | 4/2007 |
| JP | 2007085649 | A | * | 7/2007 |
| JP | 2008-101824 | A | | 5/2008 |
| JP | 2011-149648 | A | | 8/2011 |

OTHER PUBLICATIONS

Translation of JP2007085649A (Year: 2007).*
International Search Report for International Application No. PCT/JP2018/021961 dated Aug. 7, 2018, with English translation.

* cited by examiner

*Primary Examiner* — Marc E Norman
*Assistant Examiner* — Schyler S Sanks
(74) *Attorney, Agent, or Firm* — Birch, Stewart, Kolasch & Birch, LLP

(57) ABSTRACT

The present disclosure suppresses a spread of a fire occurring outside an outdoor unit of a refrigeration apparatus to a board in an electric component box and suppresses reduction of a cooling function of a heat sink mounted to the board due to a measure against the fire spread to the board. If the fire or the like, for example, burns an inside of the outdoor unit (10) and the heat sink (51) is detached from a printed wiring board, a support piece (41*g*, 41*h*, 41*i*) that is a metal capture member receives the detached heat sink (51). The support piece (41*g*, 41*h*, 41*i*) is formed such that an area in a top view of a portion of the support piece (41*g*, 41*h*, 41*i*) positioned directly below the heat sink (51) is less than 10% of an area in the top view of the heat sink (51).

8 Claims, 11 Drawing Sheets

OUTDOOR UNIT OF REFRIGERATION APPARATUS

TECHNICAL FIELD

The present disclosure relates to an outdoor unit of a refrigeration apparatus.

BACKGROUND ART

Conventionally, in an event of a fire of a building around which an outdoor unit of a refrigeration apparatus is installed, the fire may spread to and burn the outdoor unit. If the fire burns the outdoor unit and also burns an inside of the unit in this case, an electric component box may burn to an inside thereof at the same time. If the inside of the electric component box burns as in this case and fire directly burns a printed board housed in the electric component box, an investigation after the fire cannot tell whether an ignition source is the printed board or is outside the outdoor unit and cannot identify the ignition source. To address this problem, Patent Literature 1 (Japanese Patent Application Laid-open No. 2007-85649) proposes an assembly of an electric component box and its mounting structure capable of preventing a part from falling from the electric component box in a fire and capable of preventing fire from penetrating the electric component box.

SUMMARY OF THE INVENTION

Technical Problems

In the electric component box described in Patent Literature 1, however, a large area of a lower part of a heat sink is covered, which reduces a cooling function of the heat sink.

An object of the present disclosure is to suppress a spread of a fire occurring outside an outdoor unit of a refrigeration apparatus to a board in an electric component box and to suppress reduction of a cooling function of a heat sink mounted to the board due to a measure against the fire spread to the board.

Solution to Problems

An outdoor unit of a refrigeration apparatus according to a first aspect of the present disclosure includes: a board mounted with a heat generating component; a heat sink that is fixed to a lower face of the board in order to cool the heat generating component; and a metal capture member that receives the detached heat sink when the heat sink is detached from the board, wherein the capture member is formed such that an area in a top view of a portion of the capture member positioned directly below the heat sink is less than 10% of an area in the top view of the heat sink.

In the outdoor unit according to the first aspect, since the capture member is formed such that the area in the top view of the portion of the capture member positioned directly below the heat sink is less than 10% of the area in the top view of the heat sink, it is possible to suppress obstruction of an airflow flowing through the heat sink disposed on the lower face of the board by the capture member during normal operation of the outdoor unit.

An outdoor unit of a refrigeration apparatus according to a second aspect of the present disclosure is the outdoor unit according to the first aspect, wherein the capture member is disposed while leaving an insulation gap from the heat sink.

In the outdoor unit according to the second aspect, since the capture member is disposed while leaving the insulation gap from the heat sink, the insulation gap is formed between the metal capture member and the heat sink during the normal operation of the outdoor unit.

An outdoor unit of a refrigeration apparatus according to a third aspect of the present disclosure is the outdoor unit according to the first or second aspect, the outdoor unit further including a metal housing of an electric component box, the housing that houses therein the board and having such a structure as to expose the heat sink to an outside, wherein the capture member includes a protruding portion that is a protruding part of the metal housing.

In the outdoor unit according to the third aspect, the protruding portion forming the capture member is the part of the metal housing, which suppresses an amount of additional material required to form the capture member and saves the trouble of providing the capture member.

An outdoor unit of a refrigeration apparatus according to a fourth aspect of the present disclosure is the outdoor unit according to the third aspect, the outdoor unit further including a resin support that is fixed to the metal housing and supports the board, wherein the capture member is formed to support the heat sink when the resin support melts.

In the outdoor unit according to the fourth aspect, since the capture member is formed to support the heat sink when the resin support melts, it is possible to prevent the board and the heat sink from falling even if the resin support melts, which gives an evidence of starting of the fire outside the electric component box in many cases.

An outdoor unit of a refrigeration apparatus according to a fifth aspect of the present disclosure is the outdoor unit according to any one of the first to fourth aspects, wherein the capture member includes at least one support piece.

In the outdoor unit according to the fifth aspect, since the capture member includes the at least one support piece, it is possible to prevent the airflow, which flows from the lower face of the board and flows down through the heat sink, from being obstructed by the large member.

An outdoor unit of a refrigeration apparatus according to a sixth aspect of the present disclosure is the outdoor unit according to any one of the first to fifth aspects, wherein the capture member receives and supports the heat sink, detached from the board, at three positions disposed near a periphery of the heat sink.

In the outdoor unit according to the sixth aspect, since the capture member receives and supports the heat sink at the three positions disposed near the periphery of the heat sink, it is easy to make portions of the capture member for supporting the heat sink small and it is easy to dispose the capture member at such a position as not to interfere with the airflow flowing through the heat sink.

An outdoor unit of a refrigeration apparatus according to a seventh aspect of the present disclosure is the outdoor unit according to any one of the first to fourth aspects, wherein the capture member includes two support ribs extending along a periphery of the heat sink.

In the outdoor unit according to the seventh aspect, since the two support ribs extend along the periphery of the heat sink, it is easy to dispose the support ribs at such positions as not to interfere with the airflow flowing through the heat sink.

An outdoor unit of a refrigeration apparatus according to an eighth aspect of the present disclosure is the outdoor unit according to any one of the first to seventh aspects, the outdoor unit further including: a bell mouth that is disposed at a unit front face; and a fan that is disposed in the bell mouth and produces an airflow flowing from a unit back face toward the unit front face, wherein the heat sink is disposed to extend from the unit back face toward the unit front face above the bell mouth.

In the outdoor unit according to the eighth aspect, since the heat sink is disposed to extend from the unit back face toward the unit front face above the bell mouth, the airflow for cooling the heat sink enters from the back side of the unit toward the fan and flows downward from the heat sink.

Advantageous Effects of Invention

In the outdoor unit of the refrigeration apparatus according to the first aspect of the present disclosure, while suppressing reduction of a cooling function of the heat sink during the normal operation of the outdoor unit, it is possible to have the heat sink received by the capture member play a role in preventing a spread of a fire to the board when an inside of the outdoor unit burns in the fire or the like, for example.

In the outdoor unit of the refrigeration apparatus according to the second aspect of the present disclosure, it is possible to prevent an insulation failure caused by contact between the metal capture member and the heat sink.

In the outdoor unit of the refrigeration apparatus according to the third aspect of the present disclosure, it is possible to cut a cost of providing the capture member.

In the outdoor unit of the refrigeration apparatus according to the fourth aspect of the present disclosure, it is possible to increase opportunities to make use of the heat sink and the board for an analysis of a cause of a fire when the outdoor unit is burnt in the fire, for example.

In the outdoor unit of the refrigeration apparatus according to the fifth aspect of the present disclosure, it is possible to sufficiently suppress reduction in cooling performance of the heat sink.

In the outdoor unit of the refrigeration apparatus according to the sixth or seventh aspect of the present disclosure, it is easy to provide the capture member without obstructing the airflow for cooling the heat sink.

In the outdoor unit of the refrigeration apparatus according to the eighth aspect of the present disclosure, sufficient airflow is produced without interference with the capture member and it is easy to secure the cooling performance of the heat sink.

DESCRIPTION OF EMBODIMENT

(1) Overall Structure

Figure 1:
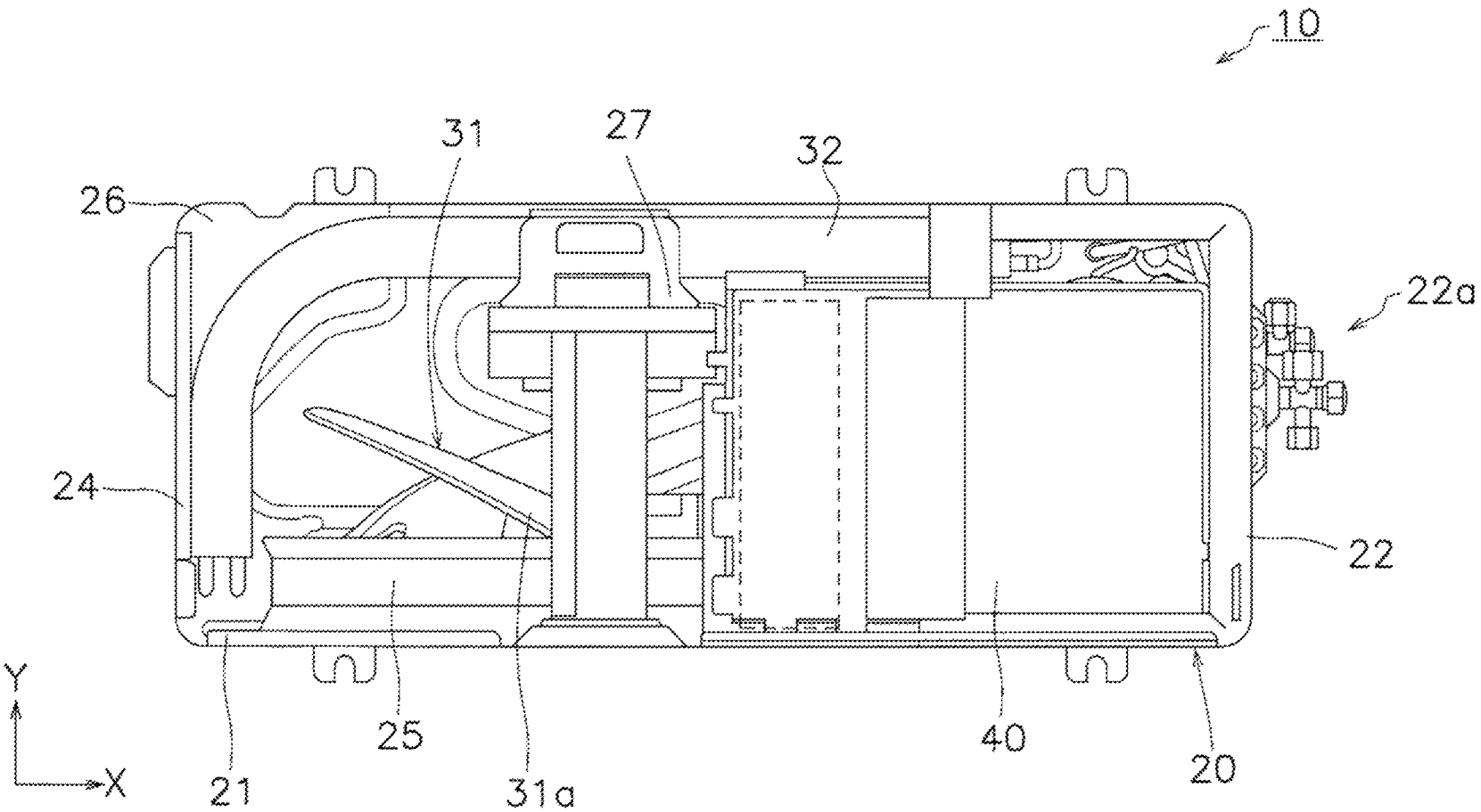
FIG. 1 is a plan view of an outdoor unit according to an embodiment with a top panel and the like detached.

FIG. 1 is a view of an inside of an outdoor unit of a refrigeration apparatus according to an embodiment of the present disclosure from above with a top panel and the like detached. The outdoor unit 10 includes a casing 20, and a fan 31, a heat exchanger 32, and an electric component box 40 in the casing 20. Although the outdoor unit 10 includes other devices such as a compressor, the devices which are not important for the invention are not described.

Figure 2:
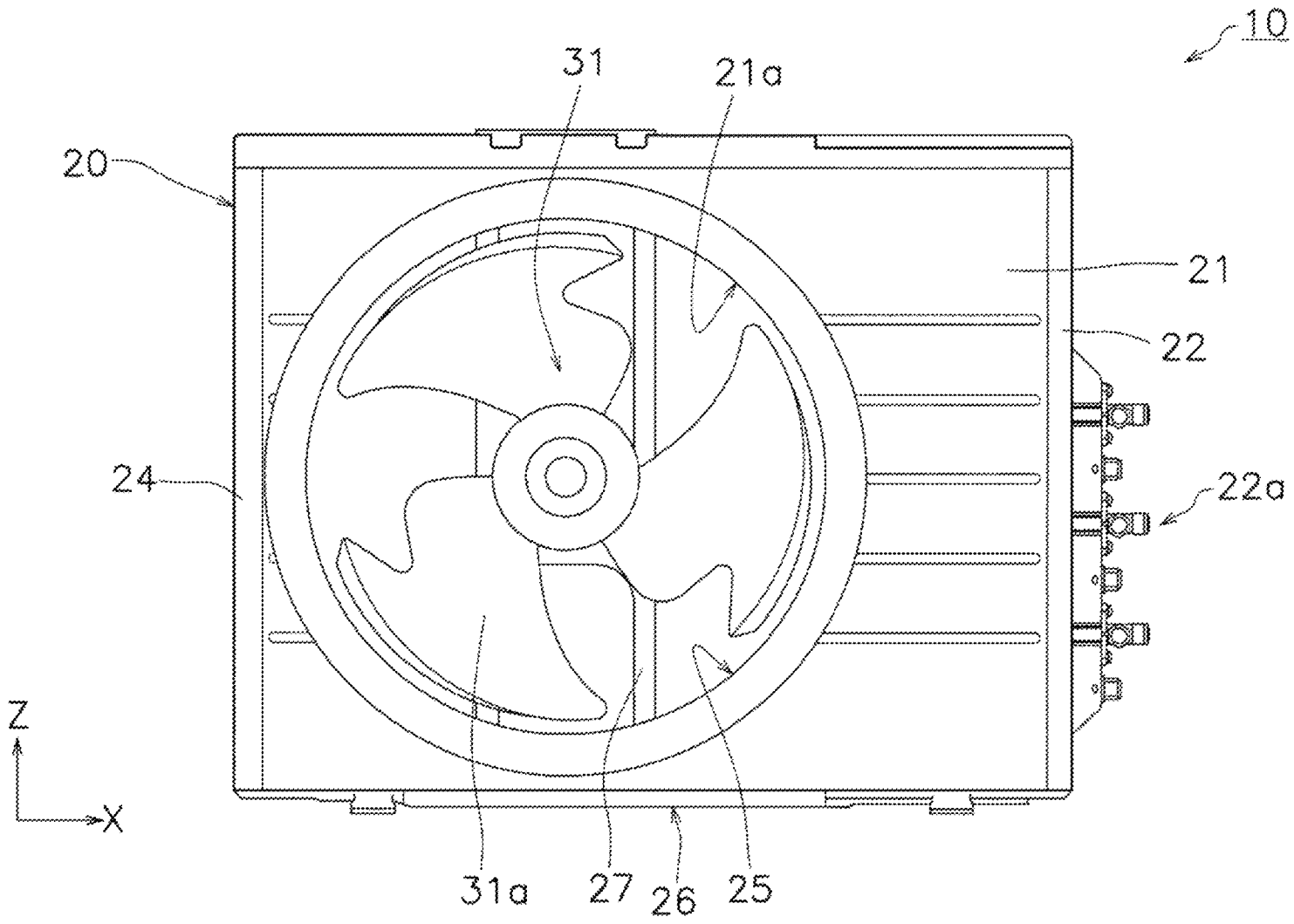
FIG. 2 is a front view of the outdoor unit in FIG. 1 with a grid, a heat exchanger, and the like detached.
Figure 3:
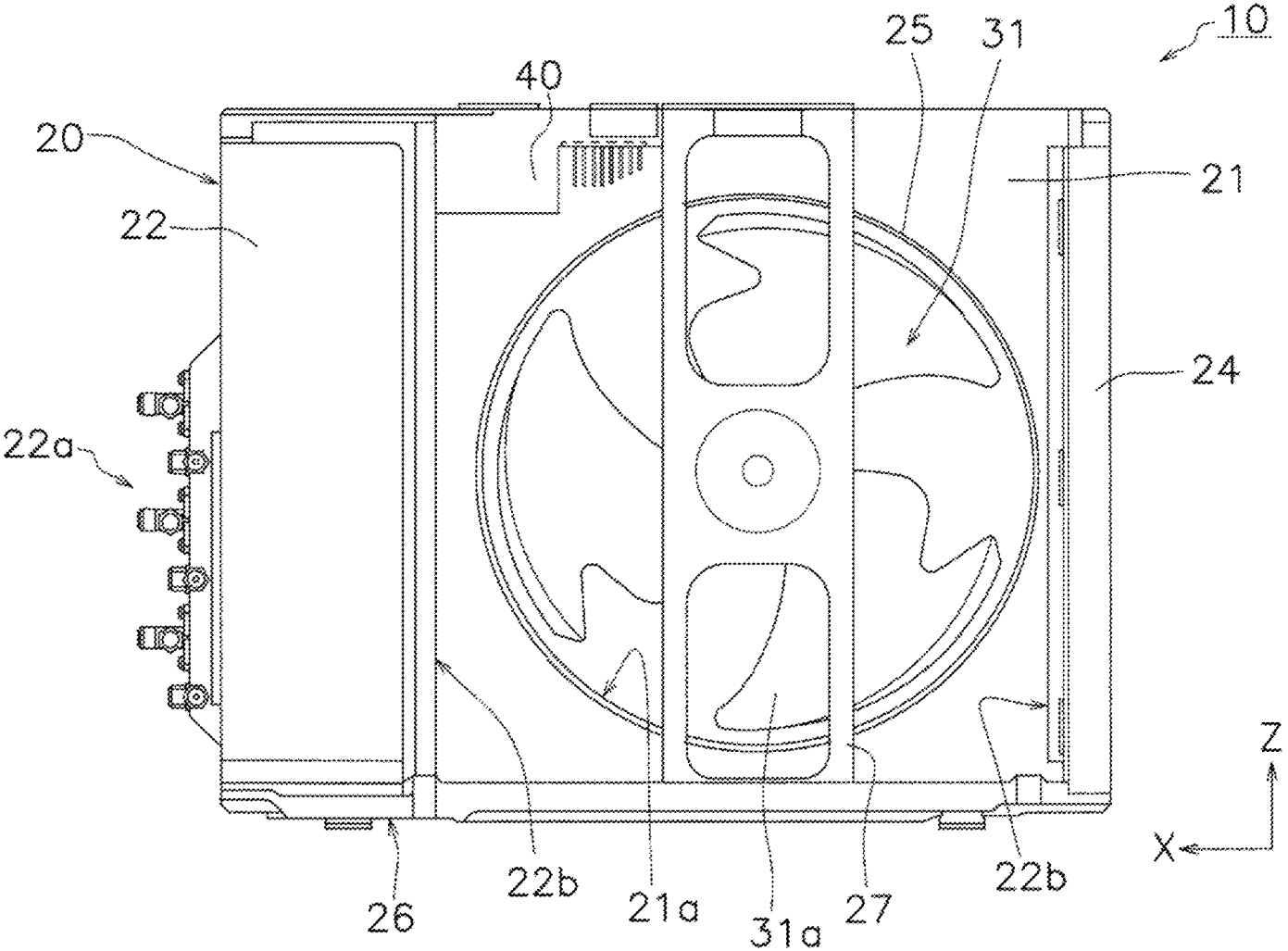
FIG. 3 is a back view of the outdoor unit in FIG. 2 with a protective metal net and the like detached.

FIG. 2 shows a front appearance of the outdoor unit shown in FIG. 1 and FIG. 3 shows a back appearance of the outdoor unit. A top panel, a grid that is provided to a unit front face for security, and the like are detached in FIG. 1, and the heat exchanger 32, a protective metal net, and the like disposed on a side of a unit back face are detached in FIGS. 2 and 3. Since the heat exchanger 32, the protective metal net, and the like are detached, FIG. 3 shows a fan motor base 27 that supports the fan 31.

The outdoor unit 10 includes the casing 20 having an appearance that is basically a rectangular parallelepiped shape with sides along a Z axis extending in a vertical direction, sides along a Y axis extending in a front-back direction, and sides along an X axis extending in a left-right direction. Although not shown in FIG. 1, the top panel formed by bending down a periphery of a rectangular metal plate that is long in the left-right (X-axis) direction and short in the front-back (Y-axis) direction is positioned on a top face of the casing 20 of the outdoor unit 10 as a finished product. Metal plates are disposed on other five faces of the casing 20 as well. A circular opening 21*a* is formed at a central portion of a front panel 21 of the casing 20 disposed on the unit front face. A connecting portion 22*a* that is connected to an indoor unit (not shown) to circulate refrigerant is provided to a right-side panel 22 of the casing 20 disposed on a unit right-side face. The right-side panel 22 is bent substantially at a right angle and covers a part of the unit back face as well. A large rectangular opening 22*b* is formed in the back face of the unit. An opening (not shown) for drawing air into the outdoor unit 10 is formed in a left-side panel 24 of the casing 20 disposed on a unit left-side face. A bell mouth 25 is provided to the front panel 21 around the circular opening 21*a* for blowing the air from an inside to an outside of the outdoor unit 10. A metal bottom frame 26 covers a bottom of the casing 20.

The fan 31 includes a propeller 31*a* disposed in the bell mouth 25 and a motor (not shown) that drives the propeller 31*a* for rotation. The heat exchanger 32 is disposed to extend along the unit back face and the unit left-side face. Air drawn into the outdoor unit 10 from the outside through the opening 22*b* and the opening in the left-side panel 24 passes through the heat exchanger 32. The fan 31 produces airflows passing through the heat exchanger 32. In other words, the fan 31 is driven to thereby produce the airflows that flow from the opening 22*b* in the unit back face, the opening in the unit left-side face, and the like and pass through the heat exchanger 32 and the bell mouth 25. A heat sink 51 (described later in detail) uses the airflows to cool electric components housed in the electric component box 40. The electric component box 40 including the heat sink 51 and the like is disposed along the top face of the casing 20 and at a position near the unit right-side face.

Here, the refrigeration apparatus refers to an apparatus having a compressor (not shown) that consumes power and the heat exchanger 32 that takes in or discharges heat, for example, like an air conditioning apparatus including the outdoor unit 10 shown in FIG. 1 and the indoor unit (not shown). In other words, the refrigeration apparatus is the apparatus that performs a refrigeration cycle in a refrigerant circuit including the heat exchanger 32.

Besides the air conditioning apparatus, examples of the refrigeration apparatus include a heat-pump hot water supply unit for supplying hot water, a refrigerator, and a cooling apparatus for cooling an inside of a warehouse.

(2) Detailed Structure (2-1) Electric Component Box 40

Figure 4:
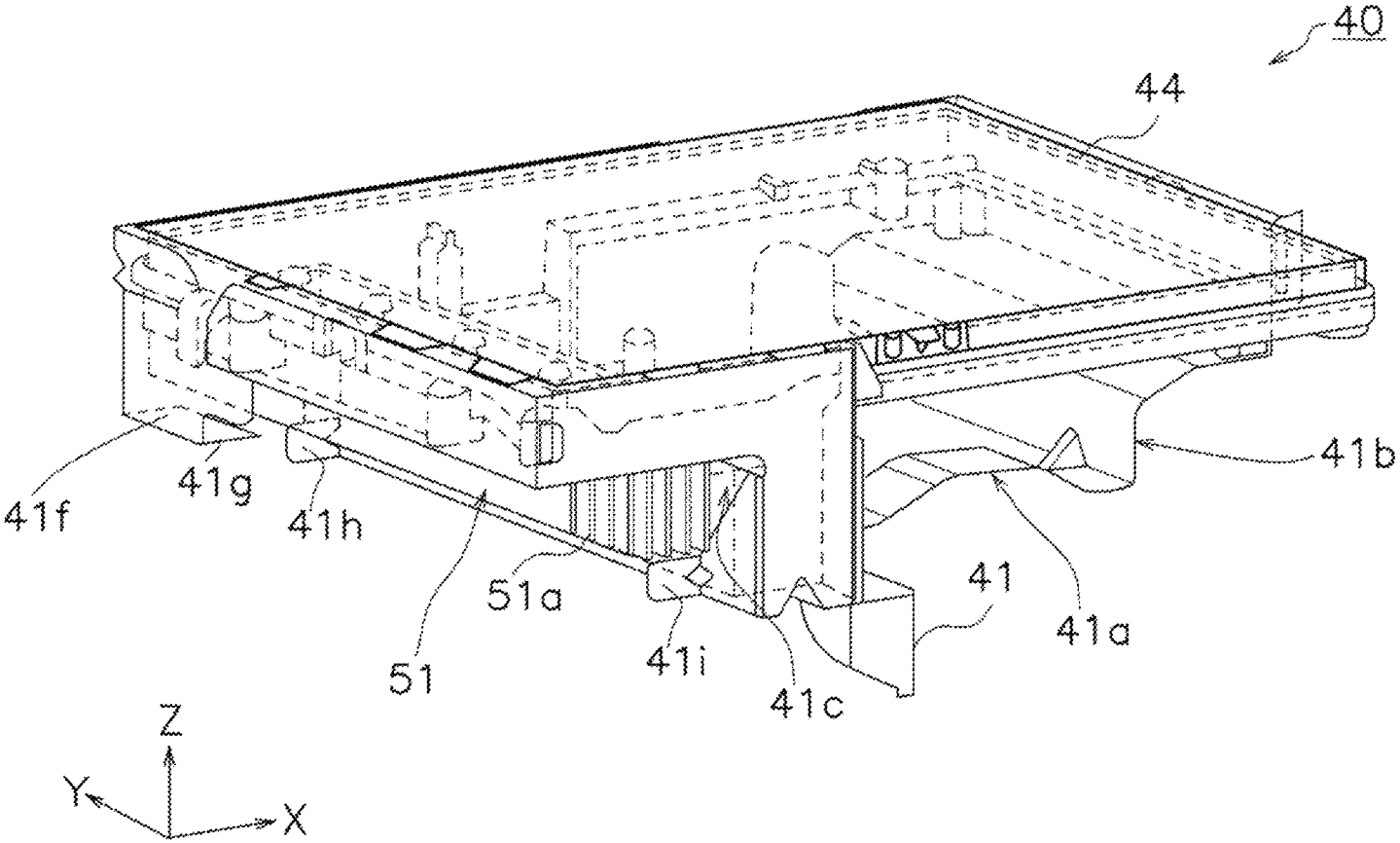
FIG. 4 is a perspective view of an electric component box according to the embodiment.
Figure 5:
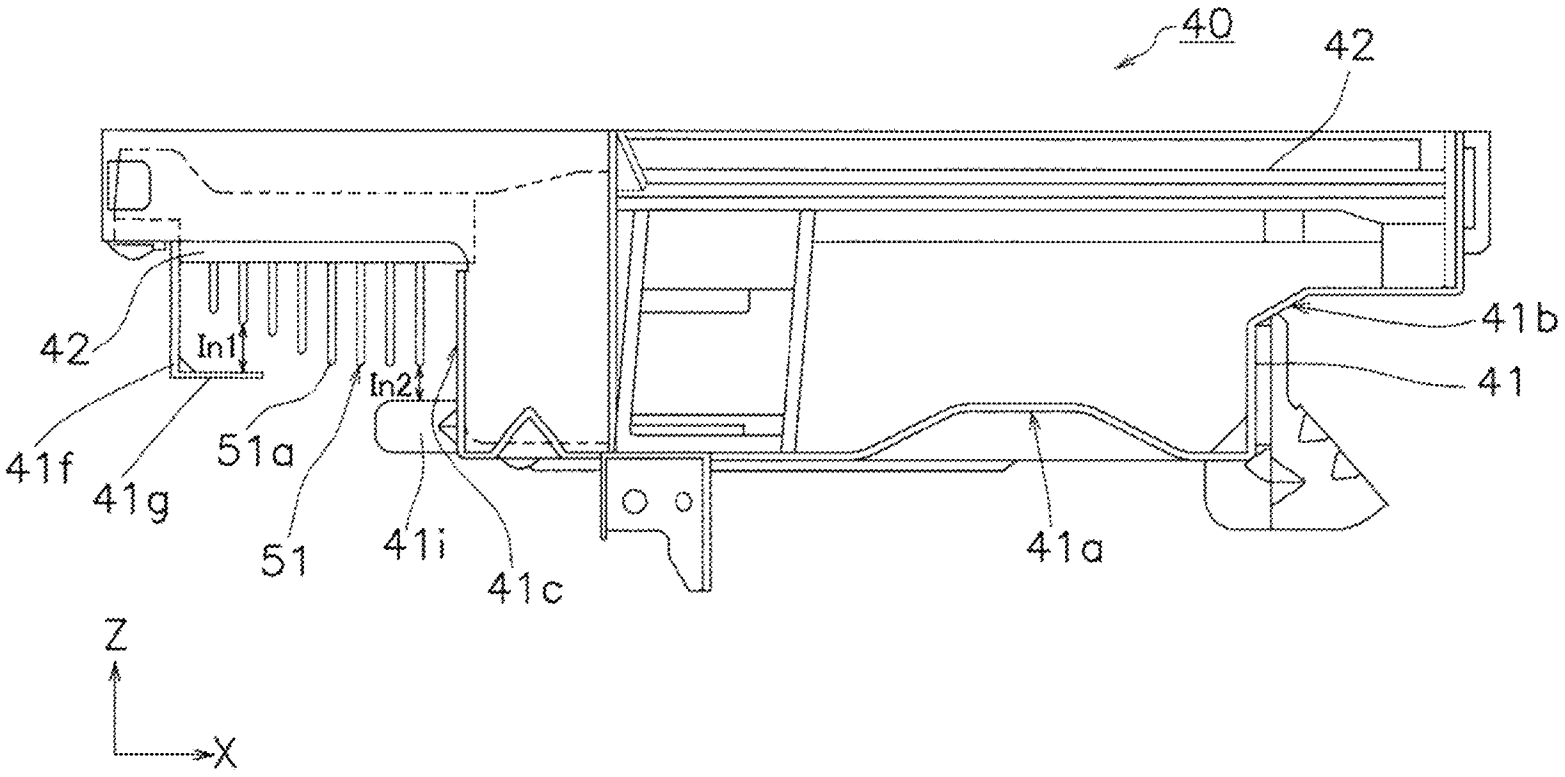
FIG. 5 is a front view of the electric component box in FIG. 4.
Figure 6:
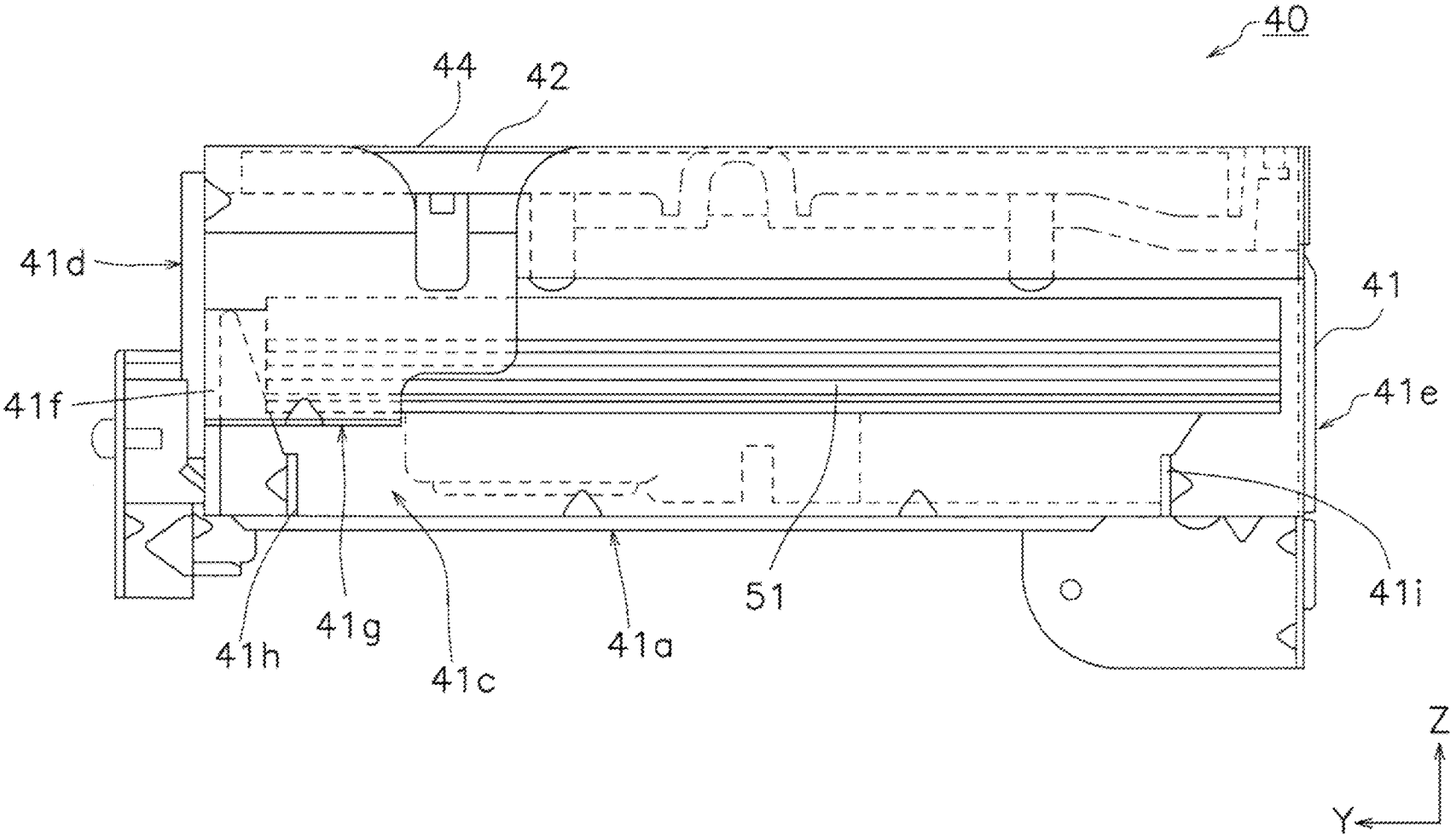
FIG. 6 is a left side view of the electric component box in FIG. 4.
Figure 7:
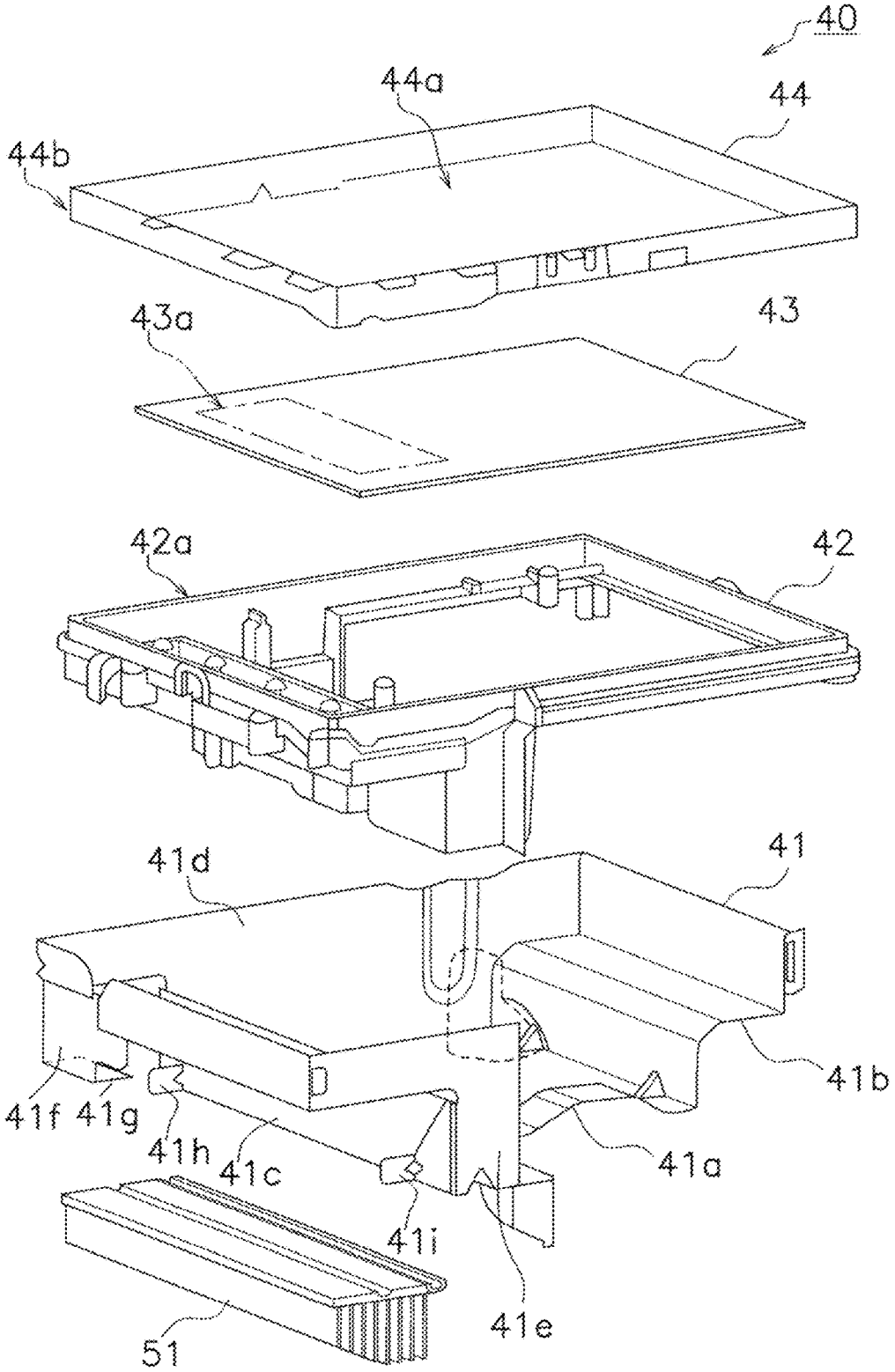
FIG. 7 is an exploded perspective view of the electric component box in FIG. 4.

FIG. 4 shows an appearance of the electric component box 40 seen from a diagonally upper left side. FIG. 5 shows an appearance of the electric component box 40 seen from a side of the unit front face. FIG. 6 shows an appearance of the electric component box 40 seen from a side of the unit left-side face. FIG. 7 is an exploded perspective view of the electric component box 40.

The electric component box 40 includes a metal housing 41, a resin support 42, a printed wiring board 43, a metal lid 44, and a metal heat sink 51.

(2-1-1) Metal Housing 41

The metal housing 41 has a bottom wall 41*a* covering a bottom face and four walls 41*b*, 41*c*, 41*d*, 41*e* rising from the bottom wall 41*a* and surrounding front, back, left, and right faces. A part of the wall 41*e* on the side of the unit front face is cut out and a part of a front-face side of the bottom wall 41*a* is cut out to form an opening for routing wires to the printed wiring board 43.

The wall 41*c* on a side of the unit left-side face has a shape vertically rising upward, bending toward the unit left-side face on its way up, and then vertically rising further upward. The wall 41*c* has an opening (not shown) formed in its horizontal portion to expose the heat sink 51 downward from the electric component box 40. On the side of the heat sink 51 near the unit left-side face, a claw portion 41*f* hangs down from the wall 41*c* and then bends toward the unit right-side face. A tip end of the bent portion serves as a support piece 41*g*. The claw portion 41*f* is disposed on a side of the wall 41*c* near the unit back face.

Support pieces 41*h*, 41*i* are formed at portions of the wall 41*c* rising from the bottom wall 41*a*. The support piece 41*h* is formed at such a position as to overlap the support piece 41*g* in the Y-axis direction. In other words, the support piece 41*g* is positioned at the same distance as the support piece 41*h* from the wall 41*e* on the side of the unit front face. The support piece 41*h* is a plate-shaped member parallel to an X-Z plane. The support piece 41*i* is formed at a position reached by the support piece 41*h* translated parallel along the Y axis toward the wall 41*e* on the side of the unit front face. The support piece 41*i* is also a plate-shaped member parallel to an X-Z plane. The support pieces 41*g*, 41*h*, 41*i* are formed by bending metal plates forming the metal housing 41. In other words, the support pieces 41*g*, 41*h*, 41*i* are protruding portions that are protruding parts of the metal housing 41. Therefore, the support pieces 41*g*, 41*h*, 41*i* are integral with the metal housing 41. The support pieces 41*h*, 41*i* only have the same widths as a thickness of the metal plate forming the metal housing 41 in a top view and produce very small air blowing resistances to the airflow flowing downward from the heat sink 51.

Figure 8:
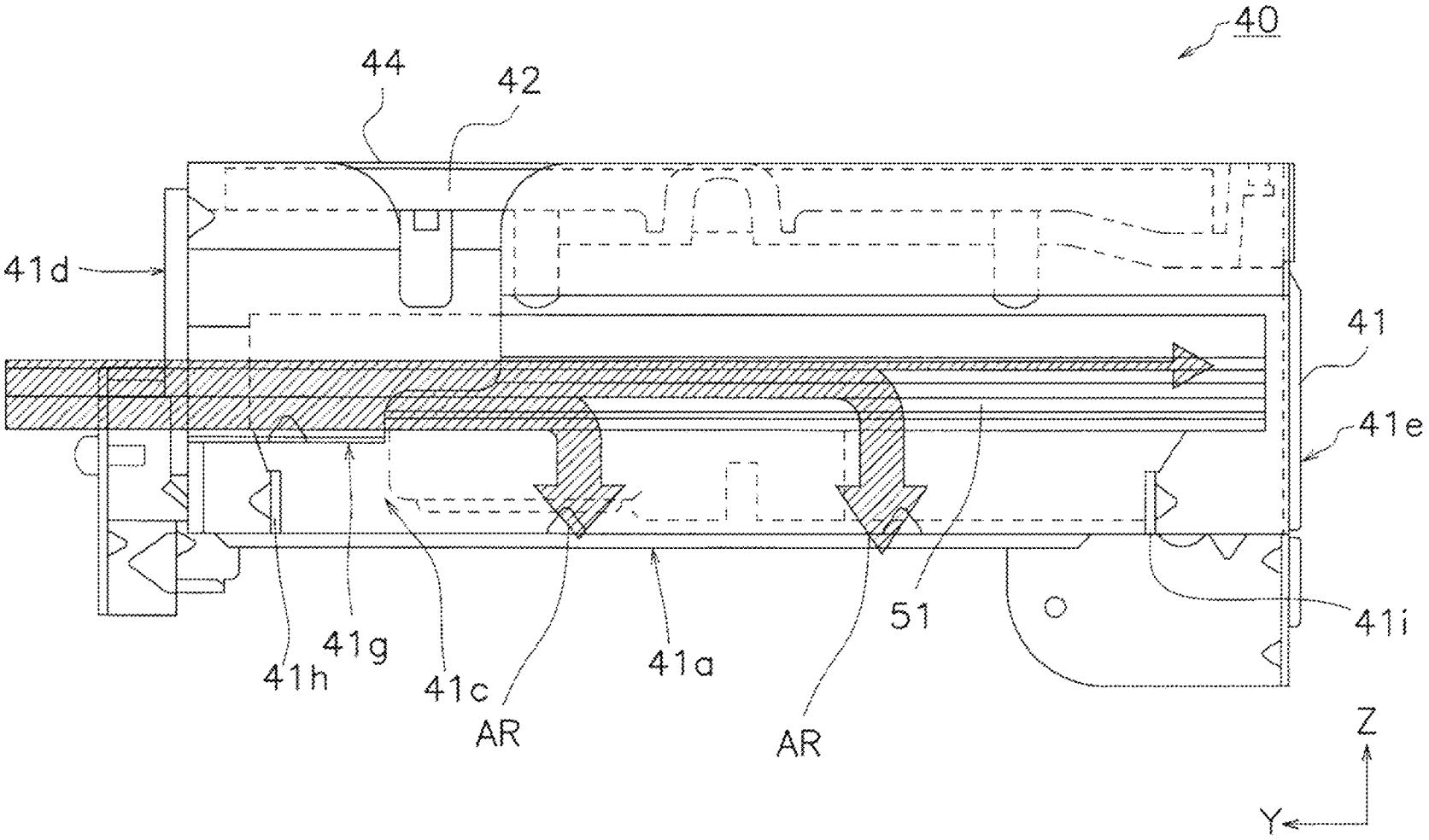
FIG. 8 is a conceptual diagram for describing airflows flowing in the electric component box in FIG. 4.

FIG. 8 shows the airflows flowing through the heat sink 51 with arrows AR. Since the heat sink 51 is at a lower position than an upper end of the heat exchanger 32 and in front of the heat exchanger 32, the airflow flowing toward the unit front face through the heat exchanger 32 enters the heat sink 51 from behind. The airflow flows through between a plurality of fins 51*a* extending in the front-back (Y-axis) direction.

Figure 9:
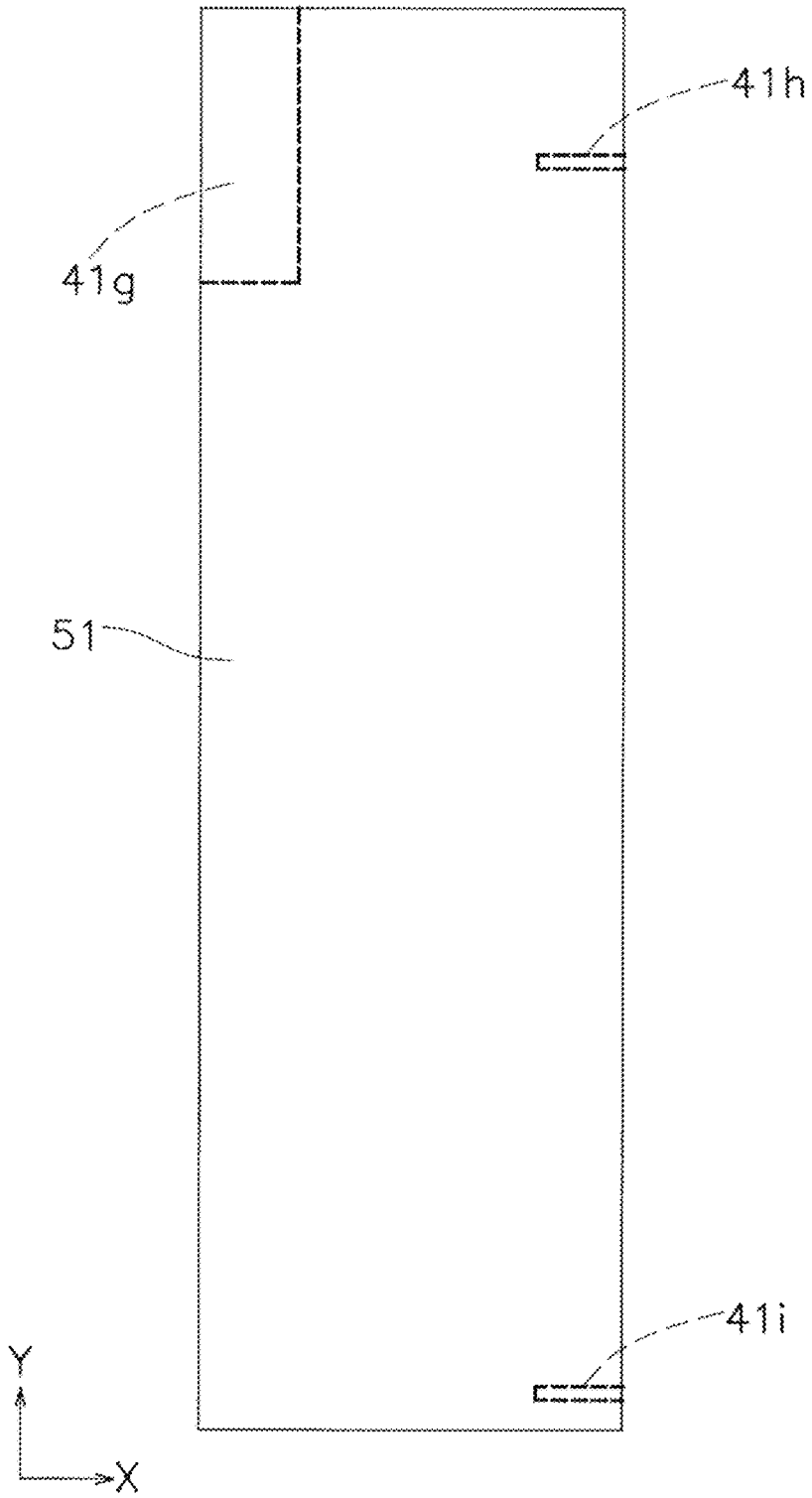
FIG. 9 is a schematic plan view showing relationships between a heat sink and support pieces.

However, the airflow is obstructed by the front panel 21 in front of the heat sink 51, does not flow straight forward, and, on its way, becomes the airflow that flows downward from the heat sink 51 toward the bell mouth 25 at a lower position. Areas in the top view of portions of the above-described support pieces 41*g*, 41*h*, 41*i* positioned directly below the heat sink 51 are preferably less than 10% of an area in the top view of the heat sink 51 so that the support pieces 41*g*, 41*h*, 41*i* produce only slight air blowing resistances to the airflow flowing through the heat sink 51. In FIG. 9, the areas of the support pieces 41*g*, 41*h*, 41*i* are less than 5% of the area of the heat sink 51. It is needless to say that the areas of the support pieces 41*g*, 41*h*, 41*i* are more than 0% of the area of the heat sink 51 in the top view.

Since the support pieces 41*g*, 41*h*, 41*i* are made of metal, insulation gaps In1, In2 are formed between the metal heat sink 51 and the support pieces 41*g*, 41*h*, 41*i* in a vertical direction to achieve insulation. However, when the heat sink 51 is detached from the printed wiring board 43 and falls down, even if the support pieces 41*g*, 41*h*, 41*i* receive the heat sink 51, a large gap is created between the heat sink 51 and the printed wiring board 43 if the insulation gaps In1, In2 are excessively large. If the large gap is created, flame easily reaches the printed wiring board 43 through the gap between the heat sink 51 and the printed wiring board 43. In this case, if the outdoor unit 10 burns in a fire or the like, an analysis for identifying an origin of the fire cannot tell whether the origin is inside or outside the electric component box 40. Therefore, the insulation gaps In1, In2 are preferably smaller than 10 mm. Sizes of the insulation gaps In1, In2 in this electric component box 40 are set in a range of 4 to 8 mm, for example. Even if the heat sink 51 falls down a distance corresponding to the sizes of insulation gaps In1, In2 in the event of the fire, entry of the flame is suppressed since the gap between the heat sink 51 and the printed wiring board 43 is small. Moreover, since the fallen heat sink 51 is surrounded with the walls 41*b*, 41*c*, 41*d*, the flame is prevented from entering the gap between the fallen heat sink 51 and the printed wiring board 43.

(2-1-2) Resin Support 42

The resin support 42 has a frame portion 42*a* formed in a rectangular annular shape in the top view and is fitted in the metal housing 41 along the walls 41*b*, 41*c*, 41*d*, 41*e* of the metal housing 41. The resin support 42 is secured to the metal housing 41 with screws, for example. The resin support 42 is a member that supports the printed wiring board 43 in an insulated state from the metal housing 41 and the metal lid 44. When the printed wiring board 43 is fitted in the resin support 42, the resin support 42 covers a periphery of the printed wiring board 43 like a frame. The resin support 42 also has a function of insulating the heat sink 51 and the metal housing 41 from each other by covering a periphery of the heat sink 51. In order to expose the heat sink 51, mounted to the printed wiring board 43, downward, the resin support 42 has an opening formed in a portion overlapping the opening in the wall 41*c*.

(2-1-3) Printed Wiring Board 43

The printed wiring board 43 has an insulation property and includes resin for this purpose. The printed wiring board 43 is a composite member made of resin and fibrous material, for example. As material of the printed wiring board 43, paper phenol, paper epoxy, or glass epoxy is used, for example. Although not shown in the drawings, a heat generating component is mounted in an area 43*a* on the printed wiring board 43. The heat generating component is an object to be cooled by the heat sink 51 and is an intelligent power module (IPM), a diode bridge, a power transistor for controlling electric power, or the like, for example. The heat sink 51 is mounted below the area 43*a* of the printed wiring board 43. The heat sink 51 is secured to the printed wiring board 43 with screws, for example. The heat generating component, for example, is mounted to the heat sink 51 with silicon resin interposed therebetween.

(2-1-4) Lid 44

The metal lid 44 has a rectangular upper face 44*a* and a rib 44*b* protruding downward from the upper face 44*a* and formed in a ring shape. The rib 44*b* of the lid 44 is formed to be fitted with an outer periphery of the frame portion 42*a* of the resin support 42.

(3) Variation (3-1) Variation 1A

Figure 10:
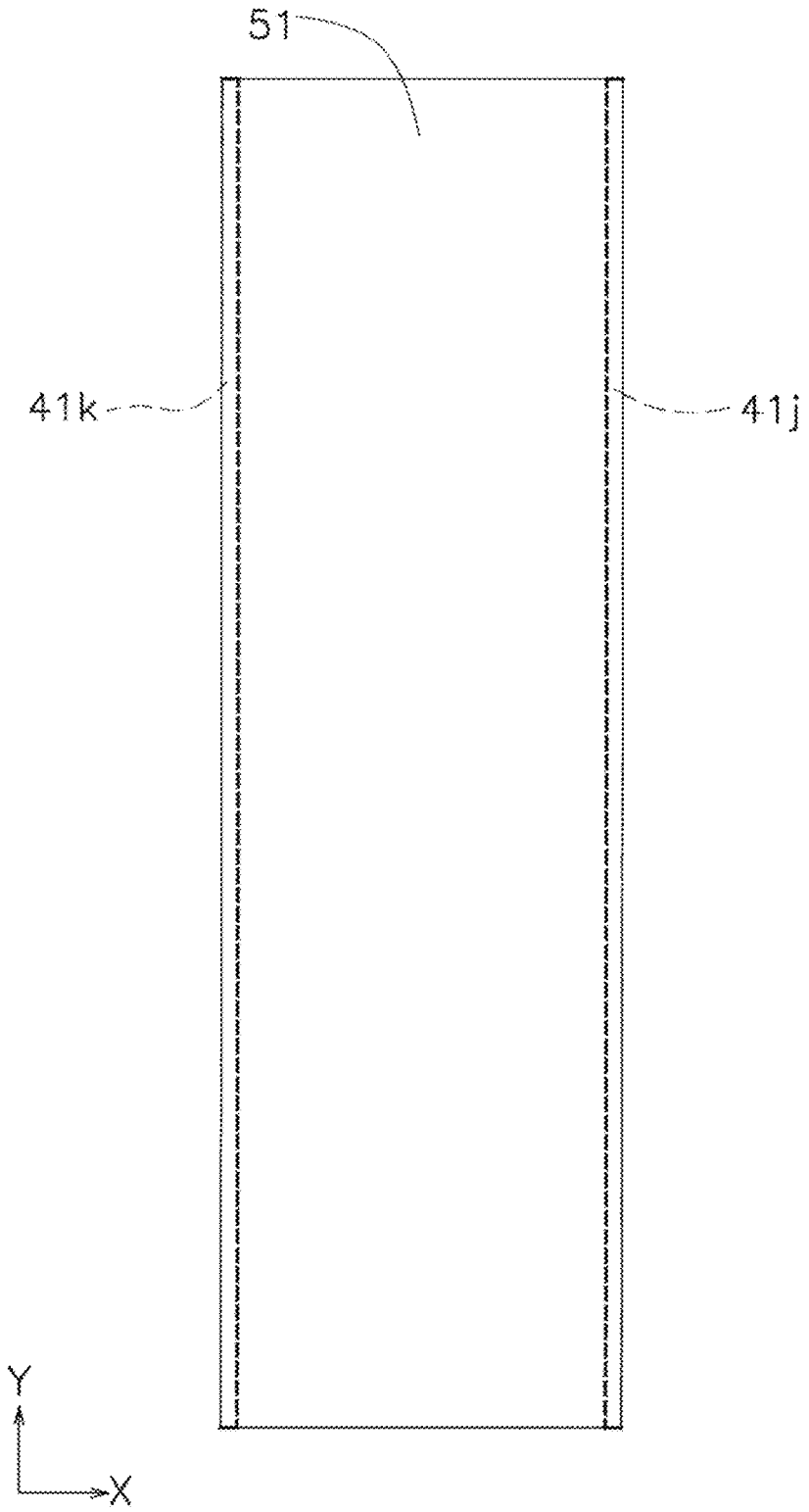
FIG. 10 is a schematic plan view showing relationships between the heat sink and support ribs.

The heat sink 51 detached from the printed wiring board 43 in the fire is received at three positions by the support pieces 41*g*, 41*h*, 41*i* in the case described in the above embodiment. Alternatively, the heat sink 51 may be received by two support ribs 41*j*, 41*k* shown in FIG. 10. Areas in the top view of the support ribs 41*j*, 41*k* are less than 10% of the area in the top view of the heat sink 51. It is preferable to form the support ribs 41*j*, 41*k* by cutting and lifting parts of the metal housing 41. Although not shown in the drawings, the support ribs 41*j*, 41*k* have insulation gaps between the heat sink 51 and themselves similarly to the support pieces 41*g*, 41*h*, 41*i*.

(3-2) Variation 1B

Figure 11:
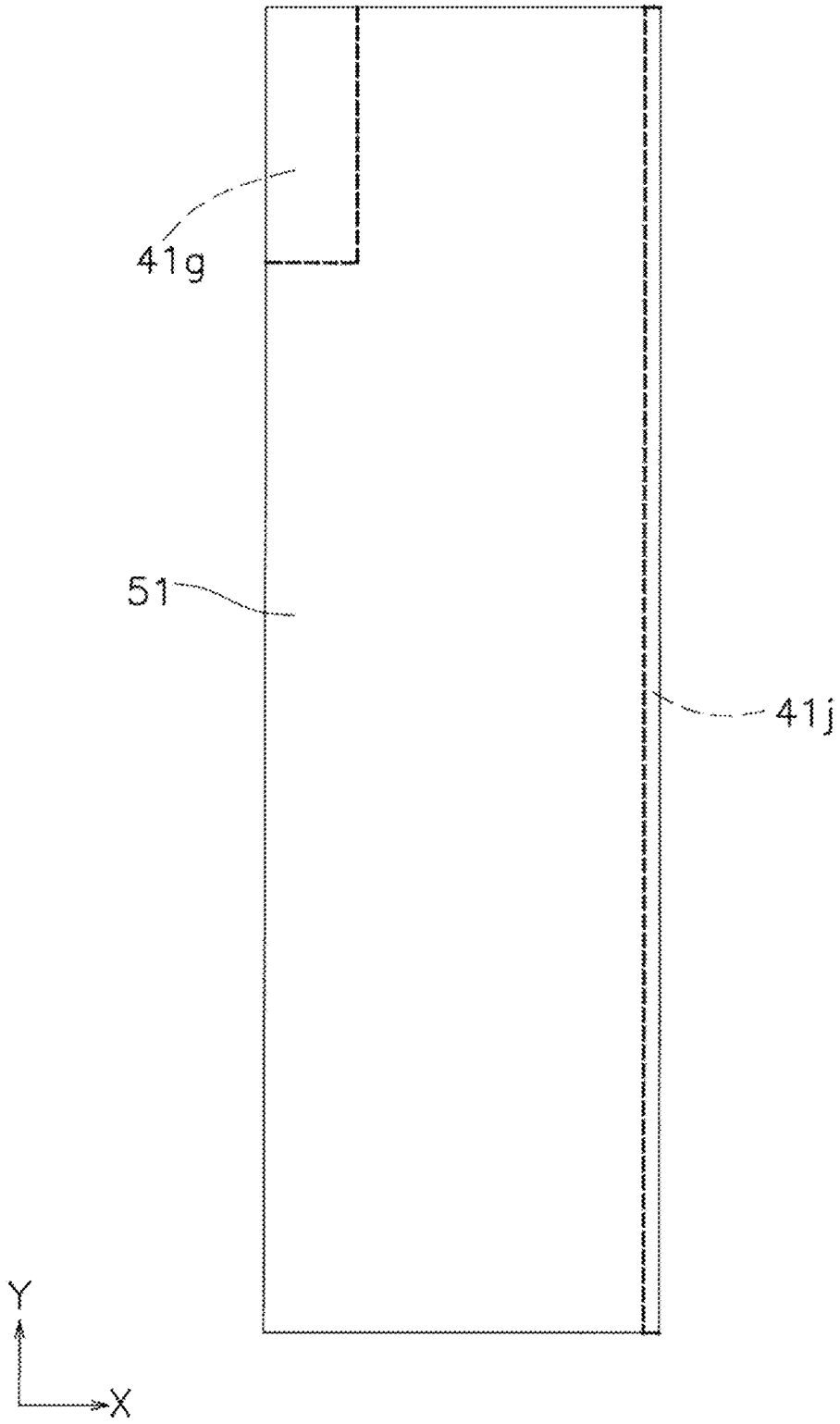
FIG. 11 is a schematic plan view showing relationships between the heat sink, the support piece, and the support rib.

Alternatively, a single support rib 41*j* and a single support piece 41*g* may form capture members as shown in FIG. 11. Furthermore, four or more support pieces may be used to form capture members, for example.

(3-3) Variation 1C

Although the support pieces 41*g*, 41*h*, 41*i* and the support ribs 41*j*, 41*k* protrude along the left-right direction (X-axis direction) in the cases described in the above embodiment and the variations 1A and 1B, support pieces and support ribs may protrude along the front-back direction (Y-axis direction), for example, and the protruding directions of the support pieces and the support ribs are not limited to the above-described direction.

(3-4) Variation 1D

In the above embodiment, the case including the only one heat sink 51 is described. Alternatively, if the electric component box 40 includes a plurality of heat sinks, each of the heat sinks may include a capture member.

(4) Characteristics 4-1

In the outdoor unit 10, the heat sink 51 is fixed to a lower face of the printed wiring board 43 in order to cool the heat generating component. If the fire or the like burns the inside of the outdoor unit 10 and the heat sink 51 is detached from the lower face of the printed wiring board 43, the support pieces 41*g*, 41*h*, 41*i* or the support ribs 41*j*, 41*k* that are the metal capture members receive the detached heat sink 51. Since the areas in the top view of the support pieces 41*g*, 41*h*, 41*i* or the support ribs 41*j*, 41*k* positioned directly below the heat sink 51 are less than 10% or even less than 5% of the area in the top view of the heat sink 51, obstruction of the airflows flowing through the heat sinks 51 and shown with arrows AR in FIG. 8, for example, by the support pieces 41*g*, 41*h*, 41*i* or the support ribs 41*j*, 41*k* that are the capture members is suppressed. As a result, during operation of the outdoor unit 10, reduction of a cooling function of the heat sink 51 is suppressed even though the support pieces 41*g*, 41*h*, 41*i* or the support ribs 41*j*, 41*k* are provided. Moreover, if the inside of the outdoor unit 10 burns in the fire or the like, for example, the heat sink 51 received by the support pieces 41*g*, 41*h*, 41*i* or the support ribs 41*j*, 41*k* can function to suppress the spread of the fire to the printed wiring board 43.

4-2

Since the support pieces 41*g*, 41*h*, 41*i* or the support ribs 41*j*, 41*k* that are the capture members are disposed while leaving the insulation gaps In1, In2 from the heat sink 51, it is possible to achieve sufficient insulation between the support pieces 41*g*, 41*h*, 41*i* or the support ribs 41*j*, 41*k* and the heat sink 51. As a result, even though the metal support pieces 41*g*, 41*h*, 41*i* or the support ribs 41*j*, 41*k* are provided directly below the heat sink, it is possible to prevent an insulation failure caused by contact between the heat sink 51 and the support pieces 41*g*, 41*h*, 41*i* or the support ribs 41*j*, 41*k*.

4-3

Since the support pieces 41*g*, 41*h*, 41*i* or the support ribs 41*j*, 41*k*, which are the protruding portions of the metal housing 41 and forming the capture members, are the parts of the metal housing 41, it is possible to cut and lift portions, which form walls, of the metal plate as the material of the metal housing 41 or it is possible to use punched-out portions, which are meant to be disposed of, from the metal plate, for example, to provide the support pieces 41*g*, 41*h*, 41*i* or the support ribs 41*j*, 41*k*, which suppresses an amount of additional material. It is possible to provide the support pieces 41*g*, 41*h*, 41*i* or the support ribs 41*j*, 41*k* simultaneously with forming of the metal housing 41 by pressing the metal plate, for example, which saves the trouble of providing the support pieces 41*g*, 41*h*, 41*i* or the support ribs 41*j*, 41*k*. As a result, it is possible to cut a cost of providing the capture members in the above-described outdoor unit 10.

4-4

Since the support pieces 41*g*, 41*h*, 41*i* or the support ribs 41*j*, 41*k* support the heat sink 51 when the resin support 42 melts, it is possible to prevent the board and the heat sink from falling down even if the resin support 42 melts, which gives an evidence of starting of the fire outside the electric component box in many cases. As a result, it is possible to increase opportunities to make use of the heat sink 51 and the printed wiring board 43 for an analysis of a cause of a fire when the outdoor unit 10 is burned in the fire.

4-5

Since the capture members include the support pieces 41*g*, 41*h*, 41*i* (i.e., at least one support piece), it is unnecessary to cover a large area of a lower portion of the printed wiring board 43 with a large member. Therefore, it is possible to prevent the airflow, which flows from the lower face of the printed wiring board 43 and flows down through the heat sink 51, from being obstructed by the large member to thereby sufficiently suppress reduction in cooling performance of the heat sink 51.

4-6

In the event that the inside of the outdoor unit 10 burns and the heat sink 51 falls down, the support pieces 41*g*, 41*h*, 41*i* receive and support the heat sink 51 at three positions arranged near a periphery of the heat sink 51. Therefore, it is easy to make portions of the capture members for supporting the heat sink 51 small and it is easy to dispose the capture members at such positions as not to interfere with the airflows flowing through the heat sink 51. As a result, it is easy to provide the capture members without obstructing the airflows for cooling the heat sink 51 in the above-described outdoor unit 10.

4-7

Since the two support ribs 41*j*, 41*k* which are the capture members extend along the periphery of the heat sink 51, it is easy to dispose the capture members at such positions as not to interfere with the airflows flowing through the heat sink 51 and it is easy to provide the capture members without obstructing the airflows for cooling the heat sink 51.

4-8

Since the heat sink 51 is disposed to extend from the side of the unit back face toward the unit front face above the bell mouth 25 in the outdoor unit 10, the airflow for cooling the heat sink 51 enters from the back side of the unit toward the fan 31 and flows downward from the heat sink 51. In this situation, since the areas in the top view of the portions of the support pieces 41*g*, 41*h*, 41*i* or the support ribs 41*j*, 41*k* which are the capture members positioned directly below the heat sink 51 are less than 10% of the area in the top view of the heat sink 51, sufficient airflows are produced without interference with the capture members and it is easy to secure the cooling performance of the heat sink 51.

Although the embodiment of the present disclosure has been described, it will be understood that various changes can be made to modes and details without departing from the gist and the scope of the present disclosure described in the claims.

REFERENCE SIGNS LIST

10 Outdoor unit
25 Bell mouth
31 Fan
32 Heat exchanger
40 Electric component box
41 Metal housing
41*g*, 41*h*, 41*i* Support piece
41*j*, 41*k* Support rib
42 Resin support
43 Printed wiring board
51 Heat sink

CITATION LIST

Patent Literature

Patent Literature 1: Japanese Patent Application Laid-open No. 2007-85649

The invention claimed is:

1. An outdoor unit of a refrigeration apparatus comprising:
a board mounted with a heat generating electronic device;
a heat sink that is fixed to a lower face of the board in order to cool the heat generating electronic device; and
a metal capture member that receives a detached heat sink when the heat sink is detached from the board,
wherein the capture member is formed such that the area in a top view of a portion of the capture member positioned directly below the heat sink is less than 10% of the entire area of the heat sink in the top view, thereby creating a continuous and unobstructed space directly below a majority of the heat sink.

2. The outdoor unit of a refrigeration apparatus according to claim 1, wherein
the capture member is disposed while leaving an insulation gap from the heat sink.

3. The outdoor unit of a refrigeration apparatus according to claim 1, further comprising a metal housing of an electric component box, the housing houses therein the board and has such a structure as to expose the heat sink to an outside,
wherein the capture member includes a protruding portion that is a protruding part of the metal housing.

4. The outdoor unit of refrigeration apparatus according to claim 3, further comprising a resin support that is fixed to the metal housing and supports the board,
wherein the capture member is formed to support the heat sink when the resin support melts.

5. The outdoor unit of a refrigeration apparatus according to claim 1, wherein the capture member includes at least one support piece.

6. The outdoor unit of a refrigeration apparatus according to claim 1, wherein the capture member receives and supports the heat sink, detached from the board, at three positions disposed near a periphery of the heat sink.

7. The outdoor unit of a refrigeration apparatus according to claim 1, wherein the capture member includes two support ribs extending along a periphery of the heat sink.

8. The outdoor unit of a refrigeration apparatus according to claim 1, further comprising:
a bell mouth that is disposed at a unit front face; and
a fan that is disposed in the bell mouth and produces an airflow flowing from a unit back face toward the unit front face,
wherein the heat sink is disposed to extend from the unit back face toward the unit front face about the bell mouth.

* * * * *